US012520922B2

(12) United States Patent
Hutchinson

(10) Patent No.: US 12,520,922 B2
(45) Date of Patent: Jan. 13, 2026

(54) COMB DEVICE FOR REMOVAL OF HEAD LICE FROM HAIR

(71) Applicant: Eileen Hutchinson, London (GB)

(72) Inventor: Eileen Hutchinson, London (GB)

( * ) Notice: Subject to any disclaimer, the term of this patent is extended or adjusted under 35 U.S.C. 154(b) by 151 days.

(21) Appl. No.: 17/938,821

(22) PCT Filed: Mar. 30, 2021

(86) PCT No.: PCT/IB2021/052624
§ 371 (c)(1),
(2) Date: Oct. 7, 2022

(87) PCT Pub. No.: WO2021/205285
PCT Pub. Date: Oct. 14, 2021

(65) Prior Publication Data

US 2023/0337805 A1 Oct. 26, 2023

(30) Foreign Application Priority Data

Apr. 9, 2020 (GB) ..... 2005269

(51) Int. Cl.
*A45D 24/30* (2006.01)

(52) U.S. Cl.
CPC ..... *A45D 24/30* (2013.01)

(58) Field of Classification Search
CPC ..... A45D 24/00; A45D 24/02; A45D 24/04; A45D 24/06; A45D 24/30; A45D 24/32; A45D 24/36; A45D 2/44; A45D 8/12; A01K 13/00; A01K 13/002
See application file for complete search history.

(56) References Cited

U.S. PATENT DOCUMENTS

| | | | | |
|---|---|---|---|---|
| 5,339,840 | A | 8/1994 | Koppel | |
| 6,158,443 | A * | 12/2000 | Leman | A45D 24/30 132/219 |
| 2002/0078972 | A1* | 6/2002 | Levandovsky | A45D 24/30 132/125 |
| 2009/0314305 | A1* | 12/2009 | Bachrach | A45D 24/30 132/142 |
| 2018/0055189 | A1* | 3/2018 | Gaon | A45D 24/04 |
| 2019/0133290 | A1* | 5/2019 | Schalla | A45D 24/30 |
| 2019/0133291 | A1* | 5/2019 | Krishevski | B08B 1/50 |
| 2020/0015565 | A1* | 1/2020 | Chen | A45D 24/04 |

FOREIGN PATENT DOCUMENTS

| | | | |
|---|---|---|---|
| KR | 100895772 | B1 * | 5/2009 |
| WO | WO98/43512 | A3 | 3/1999 |
| WO | WO2017/219074 | A1 | 12/2017 |

OTHER PUBLICATIONS

KR100895772B1. Translation (Year: 2009).*
International Search Report and Written Opinion Received for PCT/IB2021052624 mailed dated May 20, 2021, 9 pages.

* cited by examiner

*Primary Examiner* — Rachel R Steitz
*Assistant Examiner* — Karim Asqiriba
(74) *Attorney, Agent, or Firm* — RC Trademark Company

(57) ABSTRACT

A comb device for assisting with the removal of head lice from hair includes a comb handle having a grip section configured to be held in a user's hand for manipulation and movement in use, and a receiver section configured to detachably receive a comb in use, and at least one comb. The comb handle and at least one comb are configured for detachable connection in use.

13 Claims, 3 Drawing Sheets

COMB DEVICE FOR REMOVAL OF HEAD LICE FROM HAIR

FIELD

The present invention relates to a comb device for assisting with the removal of head lice eggs and nits from hair. More particularly, the present invention relates to a comb device that can be adapted for use on individuals with different types of hair, from fine to coarse.

BACKGROUND

Head lice are insects that live on the human scalp and which fed on human blood. In the UK, it is estimated that two thirds of children will experience at least one case of head lice before leaving primary school.

Head lice are spread by direct contact with the hair of someone who is infected. Adult female lice lay their eggs in the head hair near the base of a hair shaft, attaching an egg to the hair by secreting a glue that hardens into a 'nit sheath' that covers the hair shaft and large parts of the egg. An example of this is shown in FIG. 1. Each egg is oval-shaped and about 0.8 mm in length. Because they are attached in this way to the hair itself, eggs cannot fall off the hair—they have to be drawn down and off the hair shaft.

The eggs and lice can be difficult to eradicate completely from a person's head. Treatments for head lice include medicinal shampoos, and combing with a very fine-toothed comb to remove lice and eggs. However, humans as a species can have a wide variety of different types of hair, depending on age and ethnicity, from fine hair such as is found on small children and at the hairline, through to coarser darker hair such as Afro-Carribbean hair. Metal combs are generally better for thick hair, while plastic short-tooth combs are best used for treating long and fine hair. For those with long or fine hair, the metal long tooth combs can easily and uncomfortably snag and pull their hair, but plastic combs may not be as effective at removal.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

It is an object of the present invention to provide a comb for assisting with the removal of head lice from hair which goes some way to overcoming the above-mentioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(5)" following a noun means the plural and/or singular forms of the noun.

Accordingly, in a first aspect the present invention may broadly be said to consist in a comb device for assisting with the removal of head lice from hair, comprising: a comb handle having a grip section configured to be held in a user's hand for manipulation and movement in use, and a receiver section configured to detachably receive a comb in use; at least one comb, the comb handle and at least one comb configured for detachable connection in use.

In an embodiment, the comb handle is angled so that the comb extends at an angle to the grip section.

In an embodiment, the angle is substantially 16 degrees.

In an embodiment, the grip section comprises a plurality of raised beads extending from the surface or surfaces of the grip section.

In an embodiment, the receiver section comprises a hollow body and a slot, the hollow body configured to receive the base of a comb via the slot and to hold this securely in position.

In an embodiment, the receiver section further comprises a pair of guide/support extensions arranged either side of the slot, and configured to receive and guide the side edges of a comb into the slot.

In an embodiment, each guide/support extension comprises a central inwardly-facing groove.

In an embodiment, the comb comprises teeth with spacing of substantially 0.08 mm.

In an embodiment, the comb comprises teeth with spacing of substantially 0.09 mm.

In an embodiment, the comb body is substantially formed from metal.

In an embodiment, the comb body is substantially formed form plastic.

In an embodiment, the at least one comb comprises one comb with teeth with spacing of substantially 0.08 mm, and one comb with teeth with spacing of substantially 0.09 mm.

In an embodiment, the body of one comb is formed form plastic and one from metal.

With respect to the above description then, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which.

DETAILED DESCRIPTION

Embodiments of the invention, and variations thereof, will now be described in detail with reference to the figures.

Figure 1:
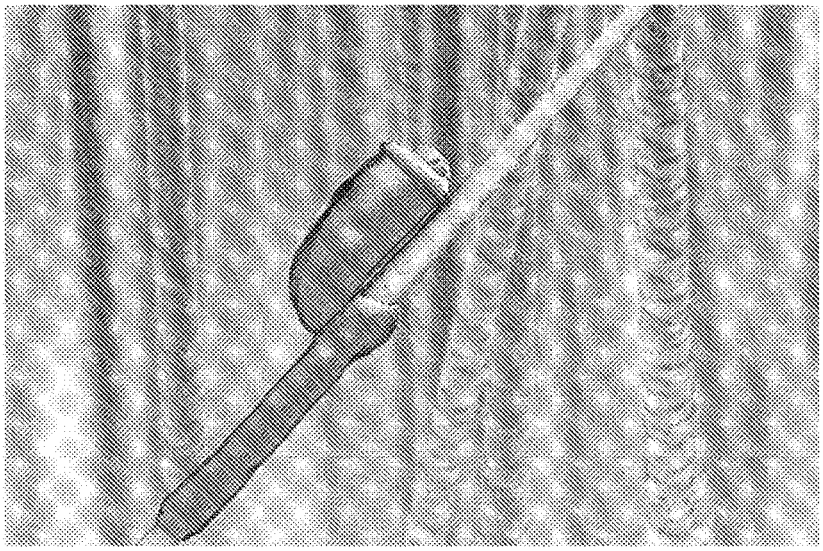
Figure 1 (Prior Art)
FIG. 1 shows an example of a louse egg attached to a hair by secreted glue hardened into a 'nit sheath' that covers the hair shaft and large parts of the egg.
Figure 2:
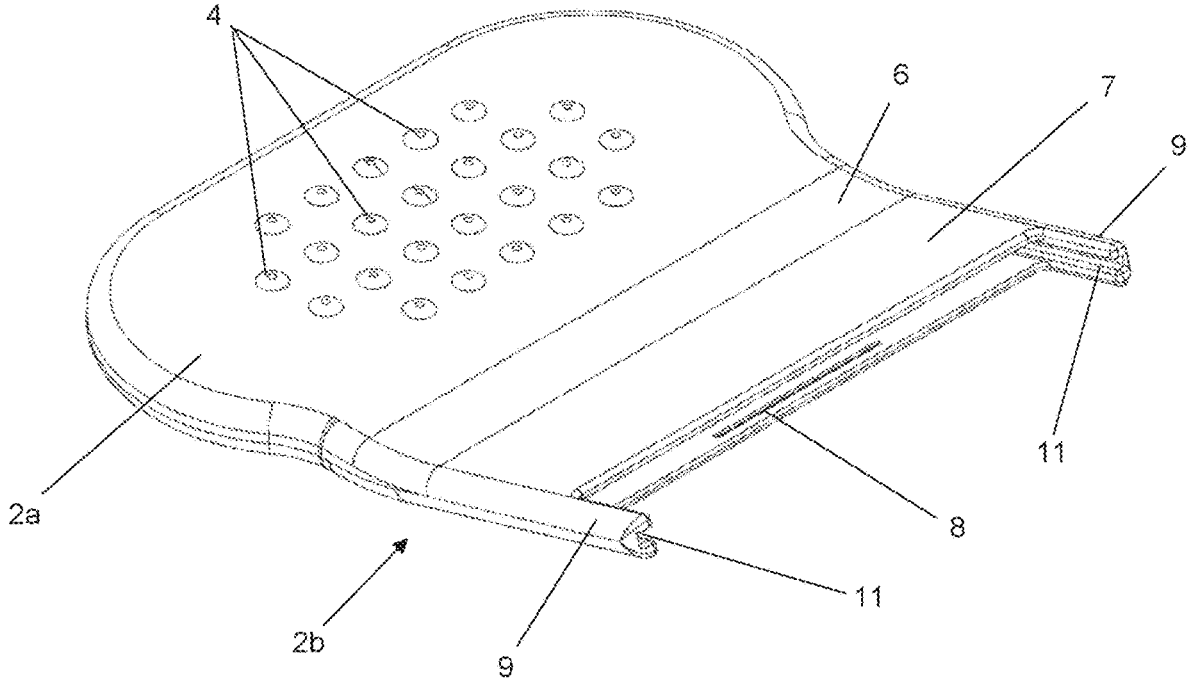
FIG. 2 shows a perspective view from the front looking rearwards and to one side and above of comb handle of a comb device according to an embodiment of the invention, the comb handle with a grip section this is configured to in use be gripped by the hand of a user, and a receiver section configured to hold a comb in use.
Figure 3:
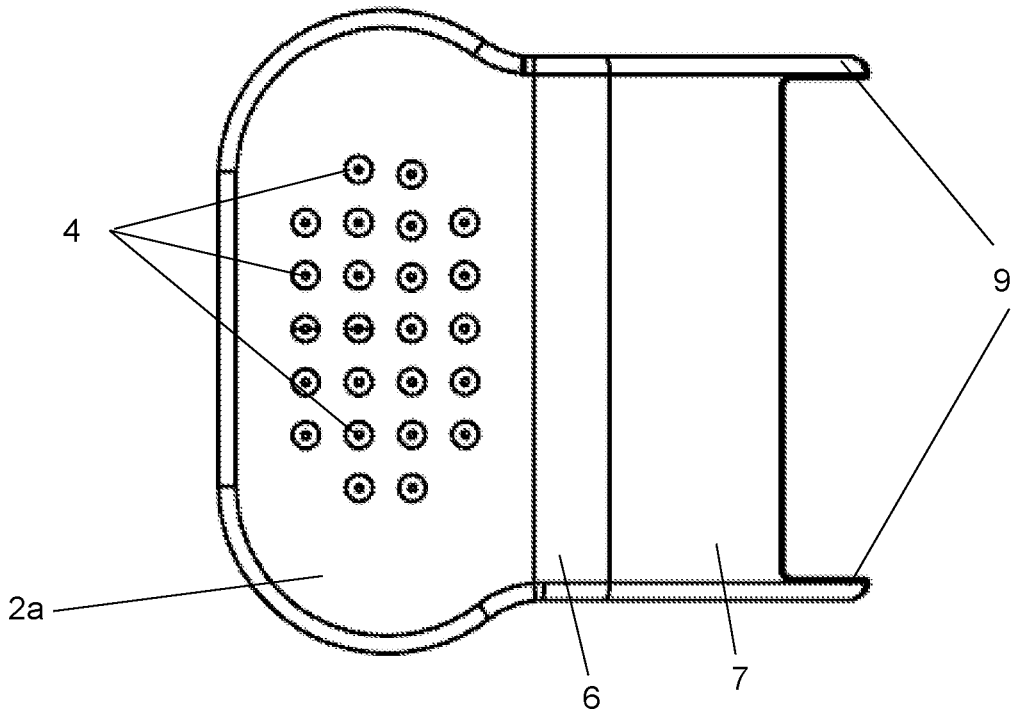
FIG. 3 shows a top view of the comb device of FIG. 2.
Figure 4:
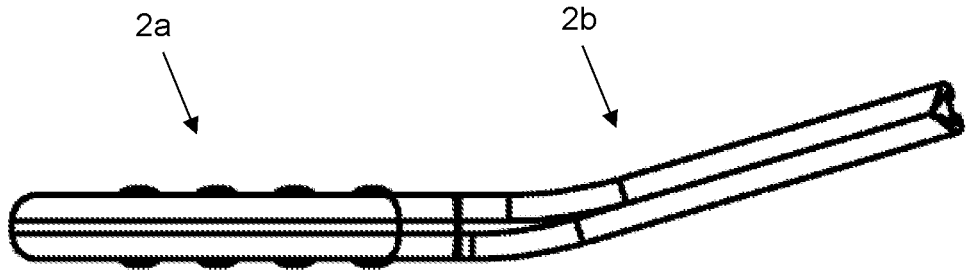
FIG. 4 shows a side view of the comb device of FIGS. 2 and 3.
Figure 5A:
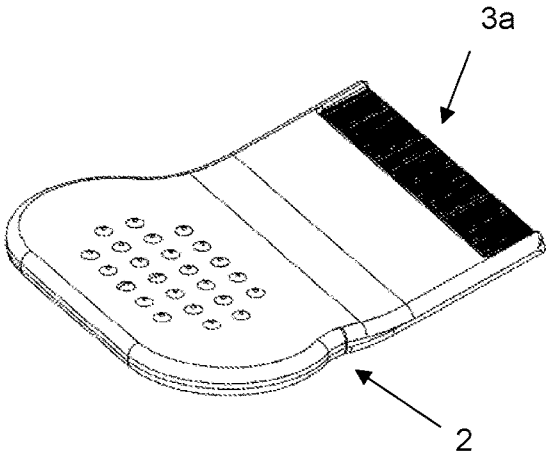
FIGS. 5*a* and 5*b* show perspective rear-side views and top views of the comb handle of FIGS. 2 to 4 fitted with a first type of comb to form a comb device.
Figure 5B:
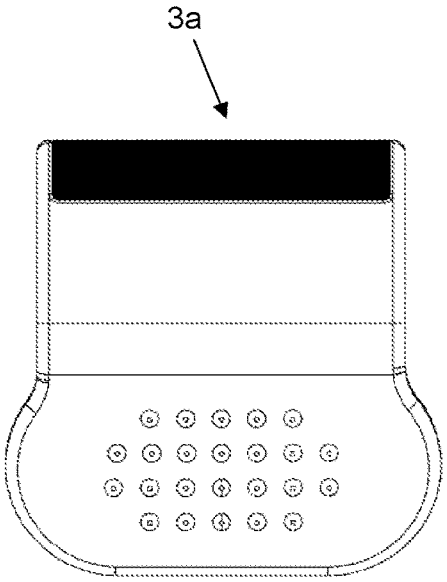
Figure 6A:
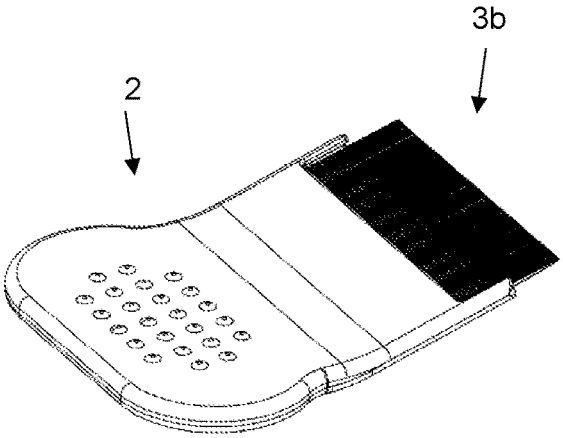
FIGS. 6*a* and 6*b* show perspective rear-side views and top views of the comb handle of FIGS. 2 to 4 fitted with a second type of comb to form a comb device.
Figure 6B:
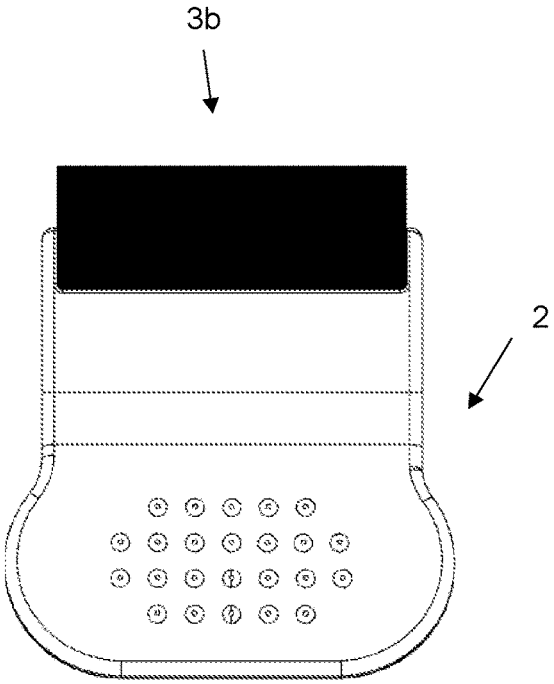

An embodiment of the comb device of the present invention is shown in FIGS. 2 to 6.

The comb device 1 has two main parts: a main body or handle 2, and a comb 3.

The comb handle 2 has a first grip section 2*a* that comprises a flat oblong section substantially 70-75 mm long, 35-40 mm wide, and 5 mm thick. This section is intended to be grasped in the hand of a user in use, between the fingers and thumb. The edge perimeter of the grip section 2*a* is rounded so that there are no sharp edges.

Domed studs or raised beads 4 extend from each side of the flat upper and lower surfaces of the first grip section 2*a*, arranged longitudinally in four straight rows of five, seven, seven and five beads, substantially centrally on each face or surface. These help to prevent the first grip section 2*a* slipping in the hand of a user in use.

An angled receiver section 2*b* extends from one long edge of the first grip section 2*a*. The receiver section 2*b* comprises a first substantially rectangular connecting section 6 approximately 10 m wide, the same thickness as the grip section 2*a*, and substantially the same length as one of the longer edges of the oblong grip section 2*a*, and a comb receiver section 7 that is integrally connected to and extends from the other side edge of the rectangular connecting section 6, having substantially the same length and thickness as the rectangular connecting section 6, and a width of 25-30 mm. The comb receiver section 7 is arranged at an angle of 16 degrees to the plane of the rectangular connecting section band first grip section 2*a*. The angle between the handle and the comb allows a greater efficiency—up to 30% more efficiency—to be achieved when combing out eggs and nits. The comb receiver section 7 comprises a hollow rectangular section the same length as the connecting section 6 with an open edge 8 on the opposite side to the connecting section. Two guide/support extensions 9 extend outwards from either side of the open edge 7, in parallel with the edges of the receiver section 7. Each guide/support extension 9 has a central inwardly-facing groove 11 that extends down from the guide/support sections 9 into the hollow body of the comb receiver section 7. The hollow section has a height/thickness of between 1-2 mm.

The hollow comb receiver section 7 in use receives the base of the comb 3. The base of the comb 3 fits snugly between the guide/support extensions 9, with the side edges of the comb 3 fitting into the grooves 11. The comb 3 is slid down between the guide/support extensions 9, and the base of the comb 3 slides into the hollow body of the comb receiver section 7 so that it is gripped firmly in use. The comb and hollow section can be configured with ridges or bumps or similar that slot into corresponding hollows or similar in the other component, so as to hold the comb firmly in position in use.

The comb 3 and receiver section 2*b* are configured so that the comb 3 can be removed and re-inserted or replaced multiple times as required.

The comb handle 2 (first grip section 2*a* and receiver section 2*b*) are formed as a substantially unitary item, from injection-moulded plastic or similar.

The comb 3 is formed from metal or plastic. Comb 3 can comprise any one of a variety of different styles of combs, with different teeth widths, and formed form different materials, so that an appropriate comb can be selected for any particular use as required.

For a typical comb 3, the preferred spacing between the teeth on is substantially 0.08 mm (comb style 3*a*, with short needles or teeth), or substantially 0.09 mm (comb style 3*b* with long needles or teeth).

A comb device according to the invention allows different types of comb suitable for different hair types to be used with a single, ergonomically-designed handle. The comb device is adaptable for use with fine hair (for example young children and hairline hair) through to coarser hair (for example adult European, Asian and Afro/Caribbean hair). Although known products are suitable and easy to use for combing out the adult head lice, it is possible for head lice eggs and nits to be left in the hair as the combs are not fine enough to draw them down and off the hair shaft. Head lice egg and nit (empty white shell) are about 0.3 mm wide. The egg does not sit on the hair—it is on a cylinder laid at the same time as the egg.

A comb device according to embodiments of the invention will allow for a more thorough combing, removing all stages of the head lice cycle, the living eggs and the dead nits.

The invention claimed is:

1. A comb device for assisting with removal of head lice, comprising:

A comb handle having a grip section configured to be held in a user's hand for manipulation and movement in use, and a receiver section configured to detachably receive one of a first interchangeable comb and a second interchangeable comb, selected by the user as a first selected comb;

wherein the receiver section comprises a hollow body, an open edge structure within the hollow body, and a slot, the hollow body configured to receive a base of the first selected comb via the slot and open edge structure to hold the selected comb securely in position; and a pair of guide/support extensions protruding away from the hollow body and arranged on both sides of the slot, configured to receive and guide side edges of the first selected comb, wherein the first selected comb is configured to be detached and replaced by the user with a second selected comb different from the first selected comb.

2. The comb device as claimed in claim 1, wherein the comb handle is angled so that the comb attached thereto extends at an angle to the group section.

3. The comb device as claimed in claim 2, wherein the angle is approximately 16 degrees.

4. The comb device as claimed in claim 2, wherein the grip section comprises a plurality of raised beads extending from a surface or surfaces of the grip section.

5. The comb device as claimed in claim 2, further comprising a pair of guide/support extensions protruding away from the hollow body and arranged on both sides of the slot, and configured to receive and guide side edges of either the first comb or the second comb into the slot.

6. The comb device as claimed in claim 2, wherein a body of one of the first and second combs is substantially formed from plastic and a body of the other one of the first and second combs is substantially formed from metal.

7. The comb device as claimed in claim 2, wherein a body of one comb is formed from plastic and one from metal.

8. The comb device as claimed in claim 1, wherein the grip section comprises a plurality of raised beads extending from a surface or surfaces of the grip section.

9. The comb device as claimed in claim 1, wherein each guide/support extension comprises a central inwardly-facing groove.

10. The comb device as claimed in claim 1, wherein a body of the first comb or the second comb is substantially formed from one of metal and plastic.

11. The comb device as claimed in claim 10, wherein the body of one of the first and second combs is substantially formed from plastic and the body of another one of the first and second combs is substantially formed from metal.

12. The comb device as claimed in claim 1, wherein the first comb comprises teeth with spacing of approximately 0.08 mm.

13. The comb device as claimed in claim 1, wherein the second comb comprises teeth with spacing of approximately 0.09 mm.

* * * * *